US006330886B1

(12) United States Patent
Culver

(10) Patent No.: US 6,330,886 B1
(45) Date of Patent: Dec. 18, 2001

(54) WIND-RESISTANT UMBRELLA

(75) Inventor: Philip H. Culver, deceased, late of Sarasota, FL (US), by Patricia M. Culver, Executrix

(73) Assignee: Aerovane Products, Inc., Sarasota, FL (US)

( * ) Notice: Subject to any disclaimer, the term of this patent is extended or adjusted under 35 U.S.C. 154(b) by 0 days.

(21) Appl. No.: 09/619,299

(22) Filed: Jul. 19, 2000

(51) Int. Cl.[7] ..... A45B 25/22

(52) U.S. Cl. ..... 135/15.1; 135/19.5; 135/20.3; 135/33.2

(58) Field of Search ..... 135/15.1, 20.3, 135/19.5, 27, 33.2, 33.4, 33.7

(56) References Cited

U.S. PATENT DOCUMENTS

| | | | | |
|---|---|---|---|---|
| 2,517,281 | * | 8/1950 | Brown . | |
| 3,345,786 | * | 10/1967 | Buzzella et al. . | |
| 3,386,455 | * | 6/1968 | O'Rear . | |
| 3,559,661 | * | 2/1971 | O'Rear . | |
| 3,930,514 | * | 1/1976 | Wu . | |
| 4,023,582 | * | 5/1977 | Buzzella et al. . | |
| 5,348,034 | * | 9/1994 | Bulgatz | 135/19.5 |
| 5,433,233 | * | 7/1995 | Shiran et al. | 135/20.1 |

* cited by examiner

*Primary Examiner*—Robert W. Gibson, Jr.
(74) *Attorney, Agent, or Firm*—Charles J. Prescott

(57) ABSTRACT

A collapsible wind-resistant umbrella including an elongated main support pole and an umbrella top. The umbrella top includes a tubular secondary pole slidably translatable over the main support pole, a hub connected at an upper end thereof to the secondary pole and supportively engaged against a support member on the main support pole whereby the secondary pole and hub are supported on the upright main support pole. A plurality of vanes, each being wider at the outer end thereof, are pivotally connected in evenly spaced relation at a central or inner end thereof to and around substantially the entire hub periphery. A vane carrier is mounted for sliding translation over the secondary pole and a plurality of rigid or semi-rigid vane support rods are pivotally connected at one end thereof in evenly spaced relation to and around substantially the entire said vane carrier periphery. The end of each said vane support rod is pivotally connected to a mid point of one longitudinal edge of each corresponding vane. An elongated endless non-elastic cord extends circumferentially around and is connected to each vane adjacent its outer or distal end. The other edge of each vane remains free and overlapping the next adjacent vane whereby a portion of each vane may lift free of the next adjacent vane in a wind to permit venting of the umbrella top.

15 Claims, 9 Drawing Sheets

16
66
64
67
56c
74
56
86
56a
20
8
72
70
68
80
78
8
56b
90
84
88
18
C
D
80
42
38
64
44
82
76
78
56

WIND-RESISTANT UMBRELLA

BACKGROUND OF THE INVENTION

1. Scope of Invention

This invention relates generally to table and beach umbrellas, and more particularly to an umbrella top formed of a plurality of separate elongated vanes or panels which are uniquely attached to one another to protect the umbrella top in wind.

2. Prior Art

Conventional table and beach umbrellas are susceptible to being upset and carried away, damaged or cause damage when strong gusts of wind are encountered. Various anchors, poles and other means of securing the elongated main umbrella pole are well known to at least partially deal with this problem. However, such anchoring means is quite dependent upon the surrounding support surface into which the anchor is positioned and may lead to damage to the main support pole itself.

Prior art teaches various attempts to provide a vented umbrella top to reduce the lifting forces and thus make them more wind resistant. However, most prior attempts do not effectively deal with the likelihood of the umbrella top becoming windborne, despite the fact that some of these attempts have become extremely complicated and inordinately heavy.

One successful attempt to answer this problem is disclosed in U.S. Pat. No. 3,386,455 invented by O'Rear which provides a wind-resistant umbrella which has been shown to be effective, relatively economically manufacturable, light weight and inexpensive. This invention, however, relies upon extreme flexibility of the individual vanes or panels and a somewhat complex support structure including a rigid periphery to support the vanes while still allowing them to flex and twist in wind.

The present invention represents an improvement over the O'Rear umbrella by eliminating many of the more heavy and cumbersome structural members and further improving the strength and configuration of each of the vanes.

BRIEF SUMMARY OF THE INVENTION

This invention is directed to a collapsible wind-resistant umbrella including an elongated main support pole and an umbrella top. The umbrella top includes a tubular secondary pole slidably translatable over the main support pole, a hub connected at an upper end thereof to the secondary pole and supportively engaged against a support member on the main support pole whereby the secondary pole and hub are supported on the upright main support pole. A plurality of vanes, each being wider at the outer end thereof, are pivotally connected in evenly spaced relation at a central or inner end thereof to and around substantially the entire hub periphery. A vane carrier is mounted for sliding translation over the secondary pole and a plurality of rigid or semi-rigid vane support rods are pivotally connected at one end thereof in evenly spaced relation to and around substantially the entire said vane carrier periphery. The end of each said vane support rod is pivotally connected to a mid point of one longitudinal edge of each corresponding vane. An elongated endless non-elastic cord extends circumferentially around, and is connected to each vane adjacent its outer or distal end. The other edge of each vane remains free and overlapping the next adjacent vane whereby a portion of each vane may lift free of the next adjacent vane in a wind to permit venting of the umbrella.

It is therefore an object of this invention to provide an improved wind-resistant collapsible umbrella with improved strength and simplified, lightened construction and manufacturing economy while remaining effective in reducing likelihood of wind damage.

In accordance with these and other objects which will become apparent hereinafter, the instant invention will now be described with reference to the accompanying drawings.

DETAILED DESCRIPTION OF THE INVENTION

Figure 1A:
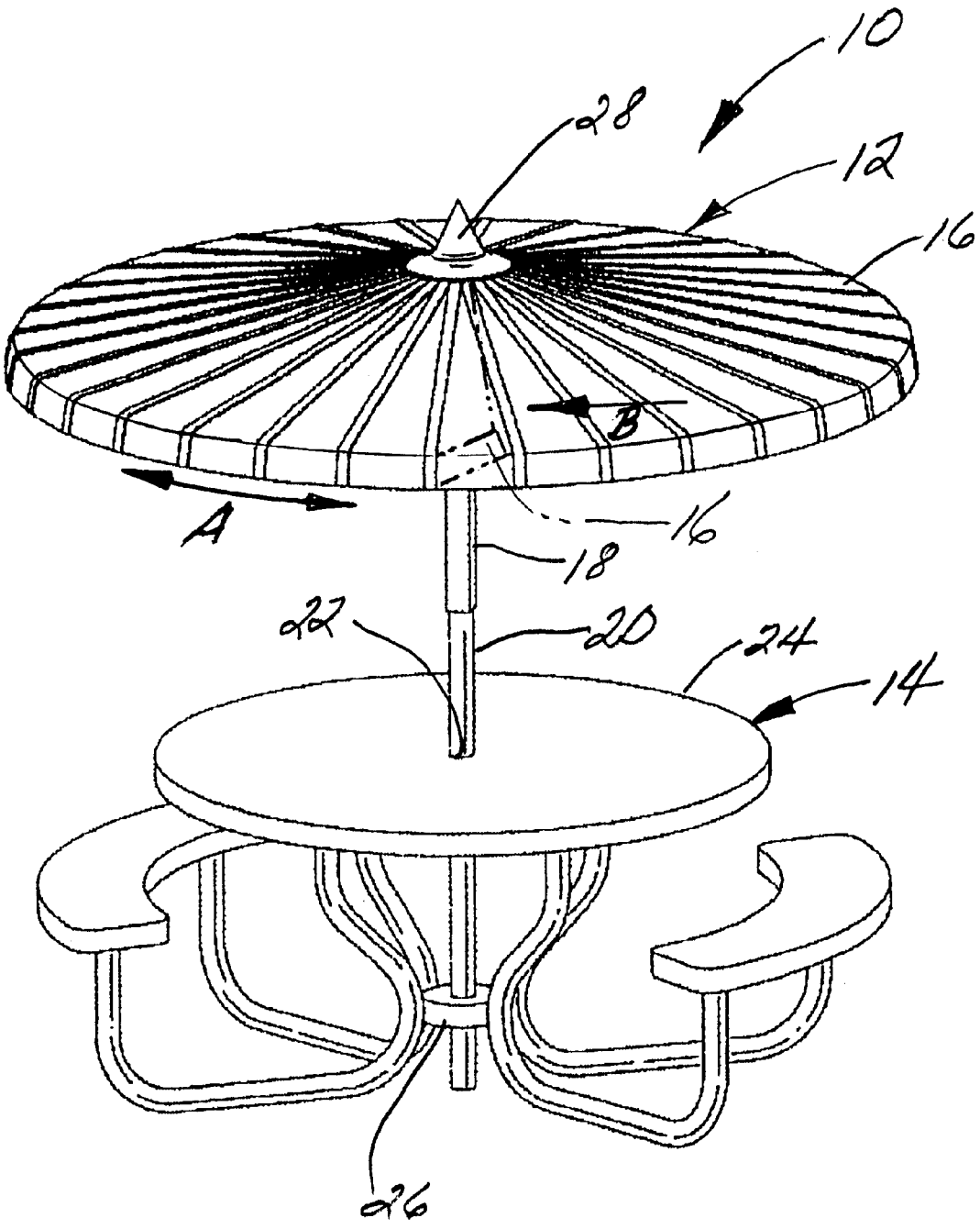
FIG. 1A is a perspective view of the invention supported by an umbrella table, the umbrella top being in an open, in-use position.
Figure 1B:
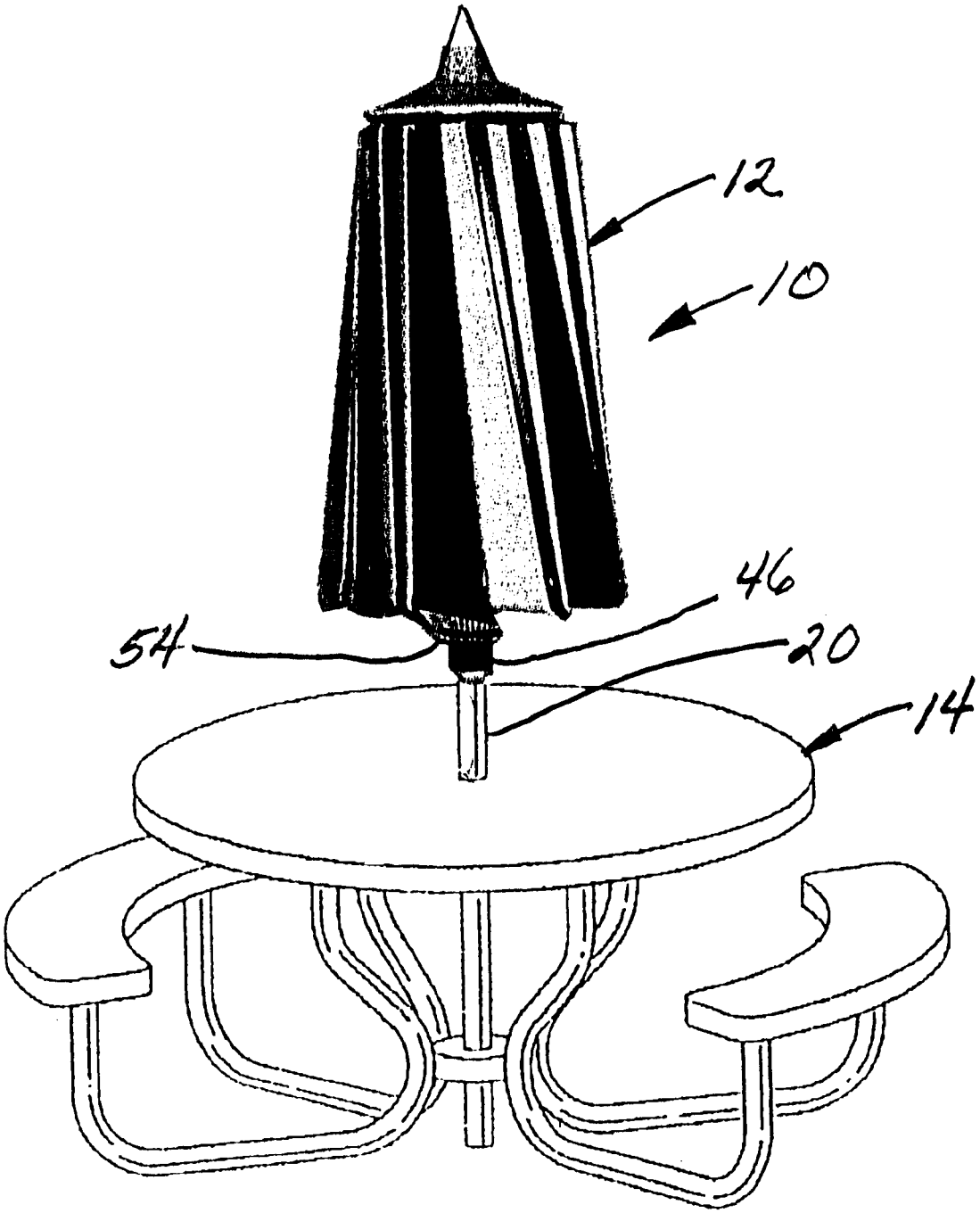
FIG. 1B is a view similar to FIG. 1 with the umbrella top in a closed position.
Figure 2:
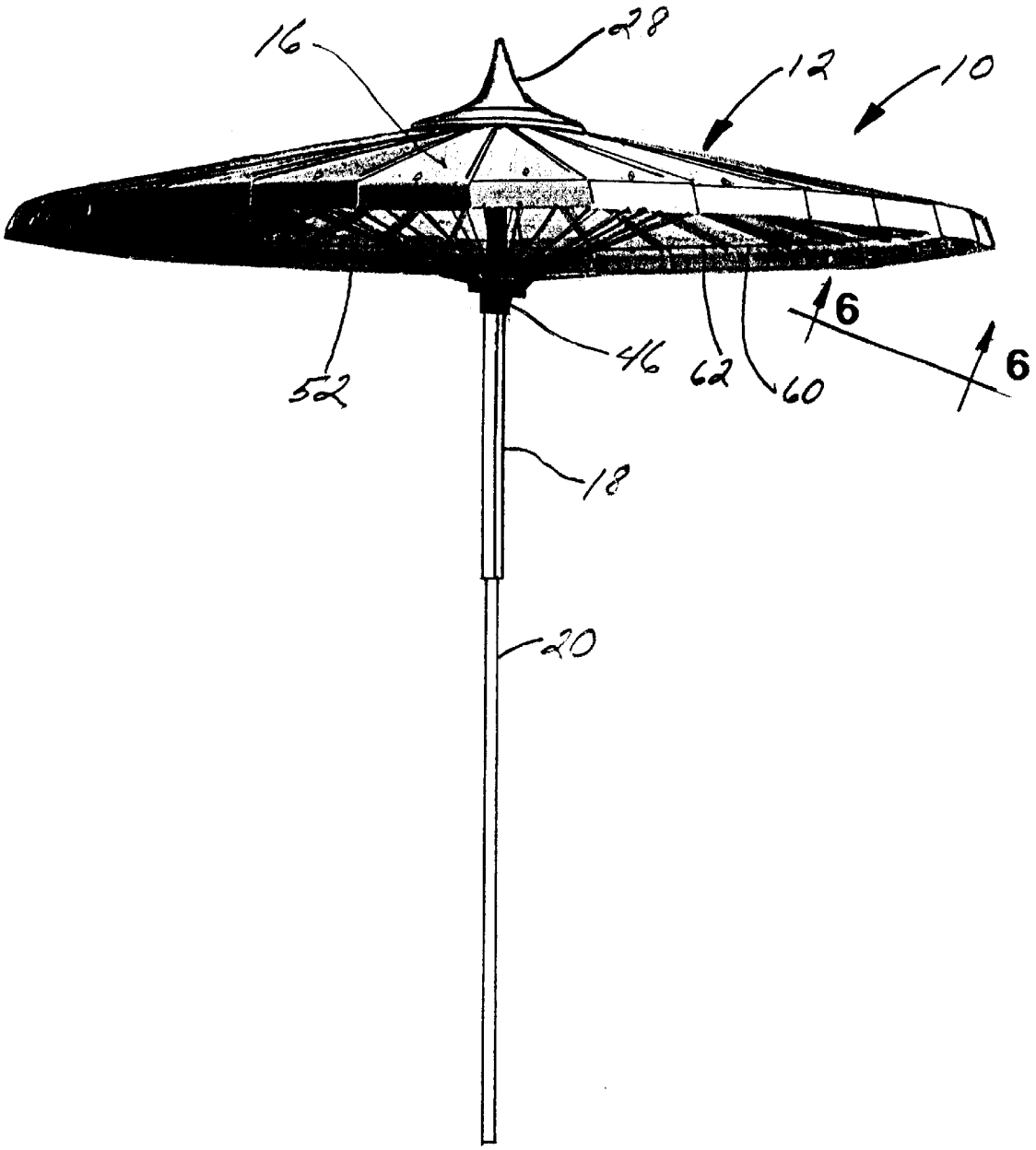
FIG. 2 is another perspective view of the umbrella top in an open position.

Referring now to the drawings, the umbrella is there shown generally at numeral 10 and includes an umbrella top 12 and, in FIGS. 1A and 1B, is shown supported by its main support pole 20 within an aperture 22 of a table surface 24 and a lower support 26 of an umbrella table shown generally at numeral 14.

Figure 4:
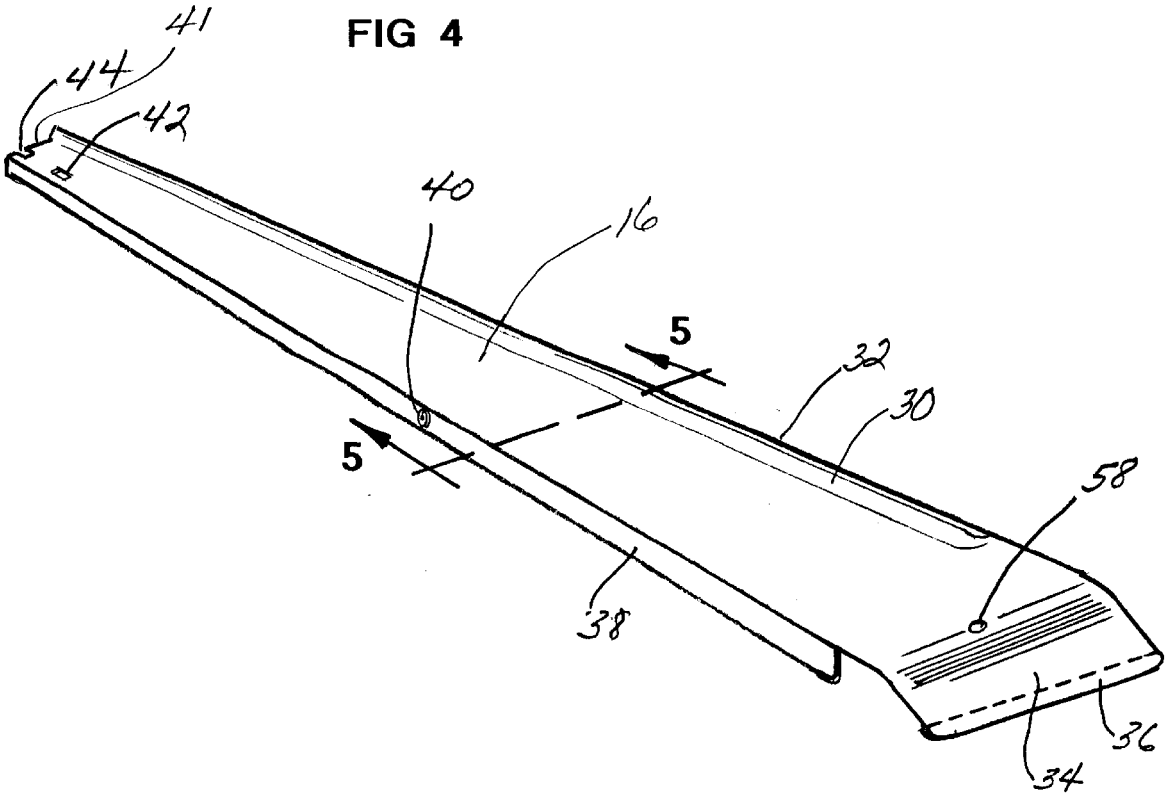
FIG. 4 is a perspective view of a vane or panel of the umbrella top.
Figure 5:
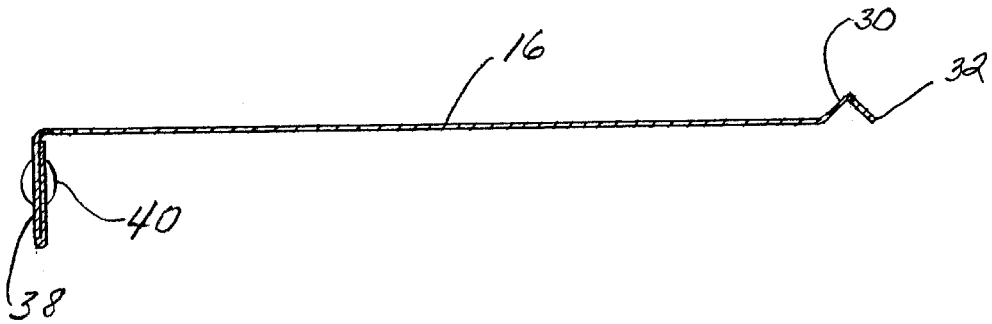
FIG. 5 is a cross section view in the direction of arrows 5—5 in FIG. 4.
Figure 6:
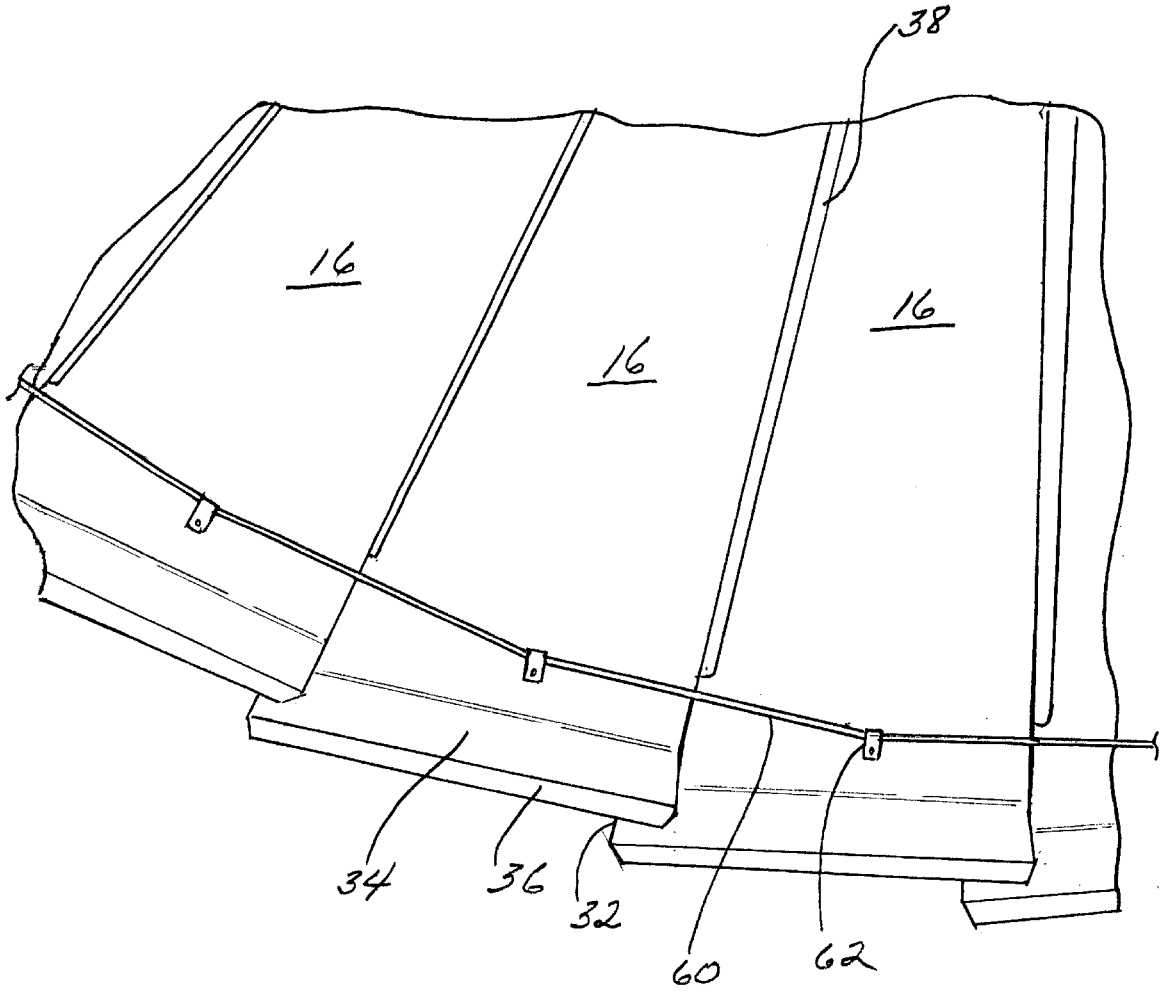
FIG. 6 is a view in the direction of arrows 6—6 in FIG. 2.

The umbrella top 12 includes a plurality of elongated vanes or panels 16 as best seen in FIGS. 4 and 5. Each of the vanes 16 is formed of thin sheet aluminum in the preferred embodiment, but molded plastic in other light somewhat flexible material may be utilized.

Each vane includes a flat central section, leading and trailing longitudinal margins 32 and 38 and an inner end 41, and an outer end 34 wider than the inner end 41. The leading longitudinal margin 32 includes a bead 30 formed along substantially the entire length thereof for added strength and stiffness and, it is believed by applicant to provide some aerodynamic benefit in wind. The trailing edge 38 is formed as a downwardly extending flange and doubled over for substantially greater strength and rigidity in this area of each vane 16.

The central or inner end 41 of each vane 16 includes an end notch 44 and a rectangular aperture 42 which facilitate connection of each vane to the hub 56 of the umbrella top 12, all of which is described herebelow in more detail. The distal or outer end 34 of each vane is downturned so as to provide a shading periphery of the umbrella top 12 when in the open position. The very distal outer edge 36 is folded over for added rigidity and for presenting a smooth edge. An aperture 58 is provided in this outer end area of each vane 16 to receive a clip which is described more fully herebelow. A rubber attaching grommet 40 is positioned along a mid point of the flanged trailing edge 38 for connection to a vane-supported rod to also be described herebelow.

Figure 3:
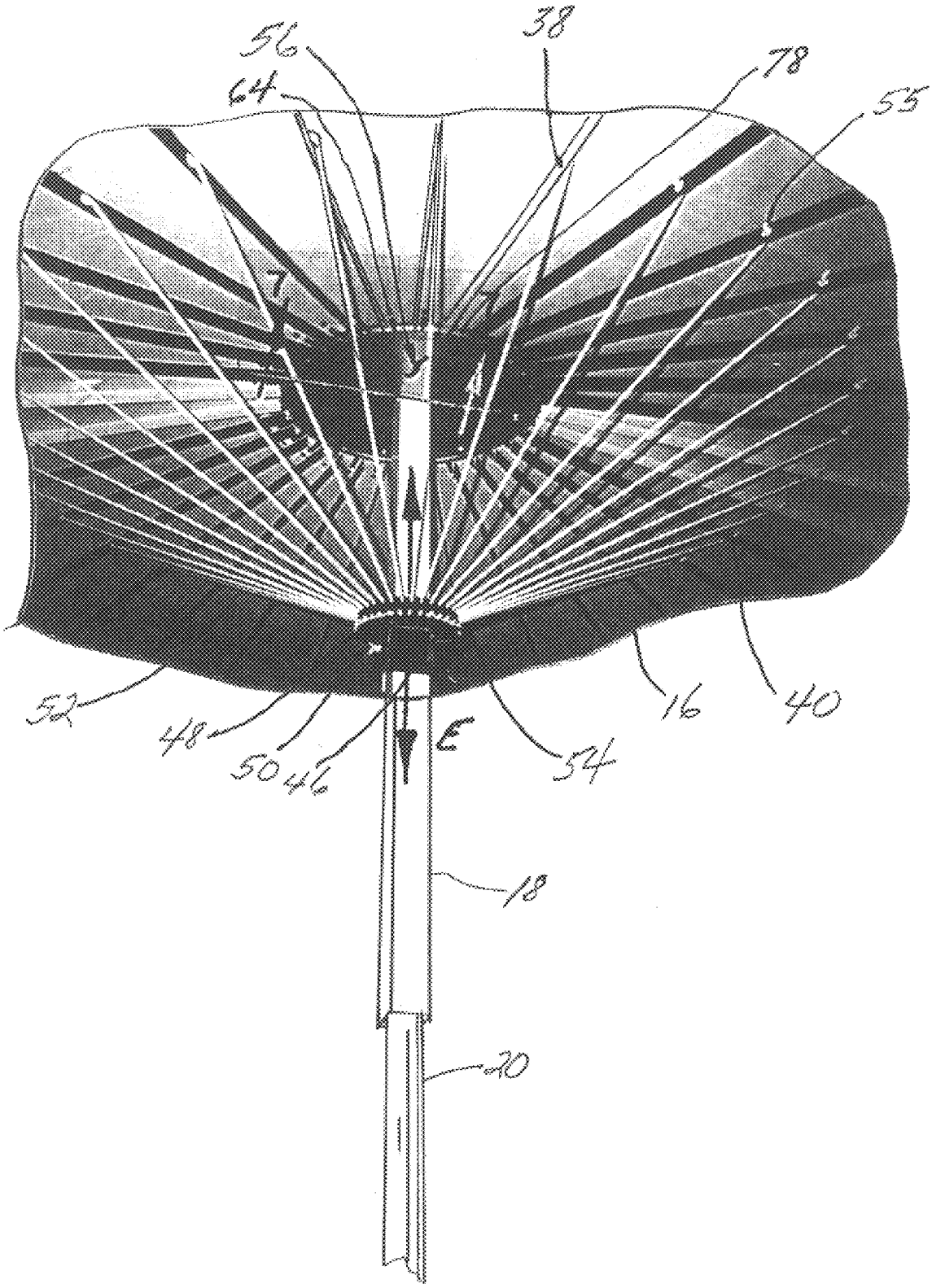
FIG. 3 is an enlarged perspective view of the central portion of the umbrella top.
Figures 7, 8:
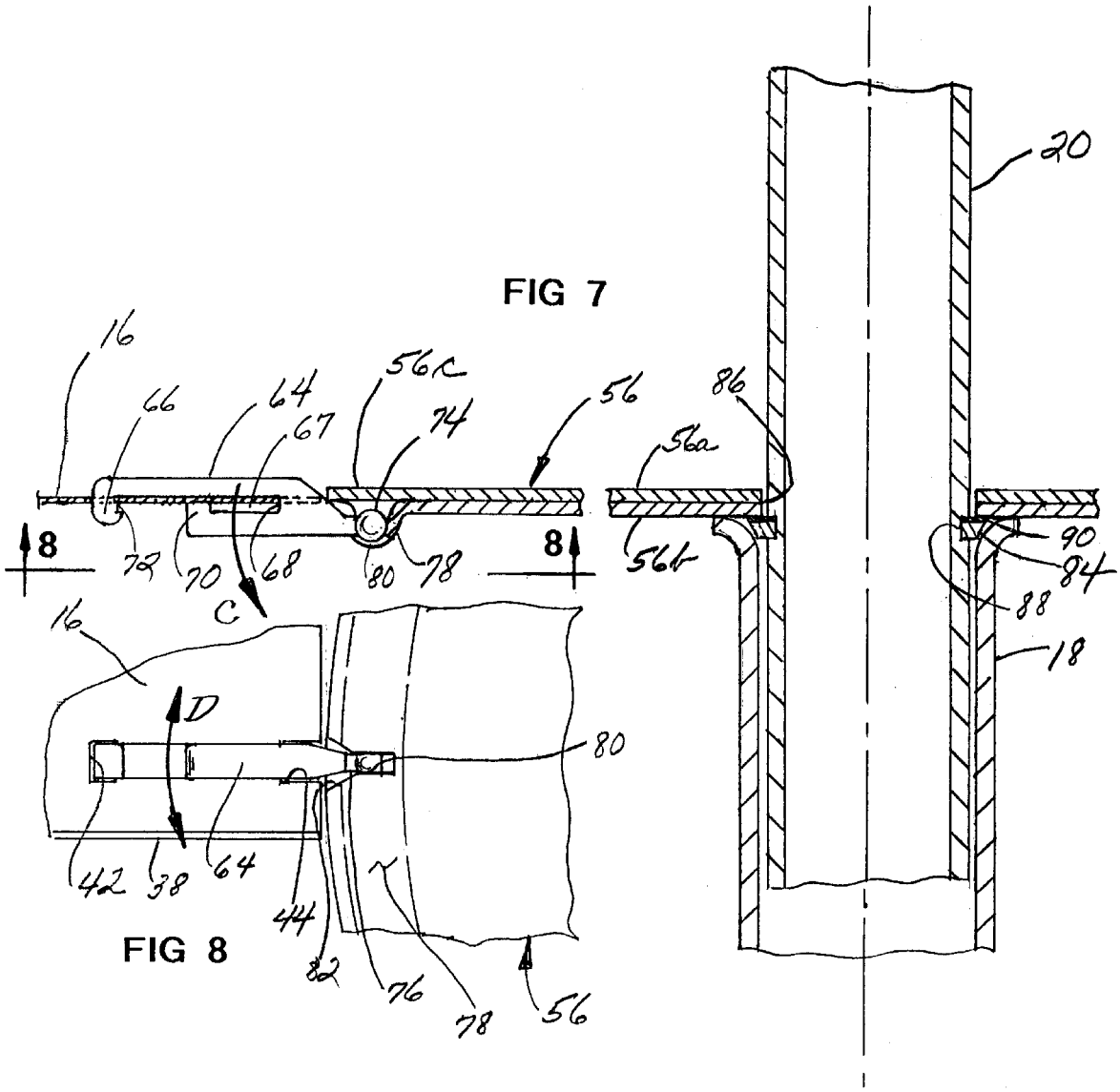
FIG. 7 is a partial section view in the direction of arrows 7—7 in FIG. 3.
FIG. 8 is a view in the direction of arrows 8—8 in FIG. 7.

As best seen in FIGS. 3, 7 and 8, a central disc-shaped hub 56 is formed of two connected together aluminum plates 56A and 56B having a central aperture 86 formed there through. A tubular secondary pole 18 is connected to, and orthogonally extends downwardly from, this aperture 86. This secondary pole 18 is substantially shorter in length than the main support pole 20 and is formed having a rectangular hollow cross section so as to loosely slidably engage over the main support pole 20. A support member 84 in the form of a concentric snap ring is fitted into groove 88 circumferentially formed into main support pole 20 and also includes an annular friction-reducing thin flat ring 90 attached to the upper surface thereof which bears against and supports the lower surface of the hub 56 adjacent aperture 86. By this arrangement, the downward weight of substantially the entire umbrella top 12 including the hub 56 and secondary pole 18, is transferred to the ground through the table-supported main support pole 20.

Figure 9:
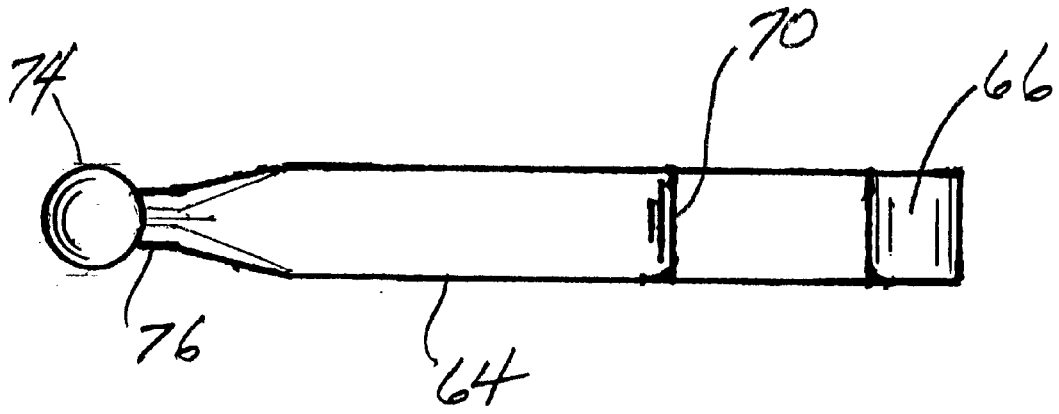
FIG. 9 is a bottom view of a molded plastic clip for universally connecting each vane to the umbrella top hub.
Figure 10:
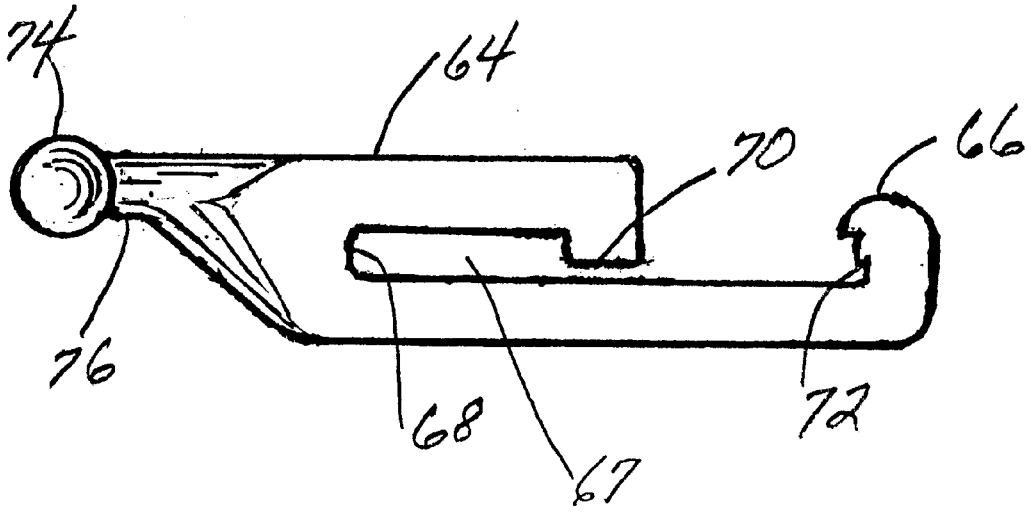
FIG. 10 is a side elevation view of FIG. 9.

The circular outer peripheral margin 56C of hub 56 includes a bead 78 formed into the lower panel 56B and evenly spaced apart notches 80 formed entirely therearound. A molded plastic vane attaching clip 64, best seen in FIGS. 9 and 10, includes a spherical ball 74 formed at one end thereof which is trapped within the bead 78 as best seen in FIGS. 7 and 8. Each notch 80 is widened at 82 so that the necked portion 76 of clip 64 will allow the clip 64 to pivotally moved downwardly in the direction of arrow C in FIG. 7, laterally back and forth in the direction of arrow D in FIG. 8 and about its longitudinal axis in limited fashion to reduce the stress and thus damage imposed upon each of the vanes 16 in wind as described more fully herebelow.

The clip 64 is snappingly connected to the vane 16 by forcibly engaging the large distal end portion 66 into the rectangular aperture 42 after notch 44 has been slidingly engaged beneath retaining tab 70 and against the end 68 of slot 67. Notch 72 is sized in height to be just slightly greater than the thickness of the aluminum sheet used to form each vane 16 (about 0.03"). Tab 70 bears against the vane 16 to prevent excessive movement and rattling once clip 64 is secured in place.

Referring again to FIGS. 1A and 1B, FIG. 2 and FIG. 3, the umbrella top 12 also includes a vane carrier 46 which closely slidably engages concentrically over the rectangular shaped outer surface of the secondary pole 18. This vane carrier 46 includes a locking member 50 which fixes the selected position of the vane carrier 46 after sliding movement in the direction of arrow E to a desired position along the length of the secondary pole 18.

The vane carrier 46 also includes a circular flange 48 defining a perimeter having a plurality of closely and evenly spaced apertures formed therethrough. Each of these apertures is structured to retainingly receive one end 54 of an elongated vane support rod 52 preferably formed of slender aluminum stock material. This end 54 of each of the vane support rods 52 is connected into one of the apertures in the flange 48 of the vane carrier 46. The other end 55 of each vane support rod 52 is pivotally connected through the grommet 40 to flange 38 of each vane 16.

By this arrangement, as the vane carrier 46 is moved in the direction of arrow E in FIG. 3 along the secondary pole 18, the umbrella top 12 is moved between the open an d closed position shown in FIGS. 1A and 1B, respectively. All of the related components being pivotally connected one to another, the movement of the vanes 16 between these two positions is greatly enhanced and facilitated.

Figure 11:
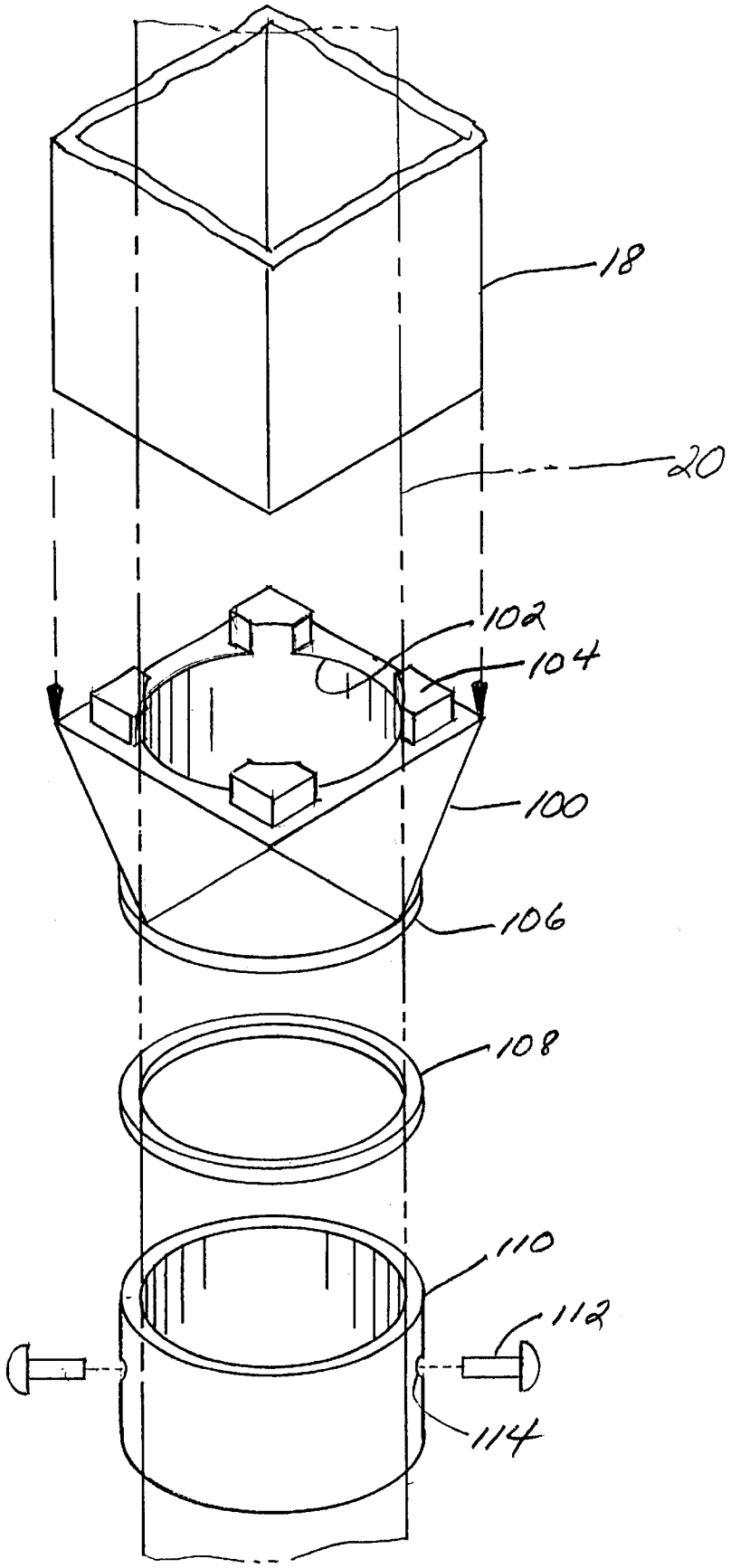
FIG. 11 is an exploded perspective view of the preferred support member for the umbrella top on the main support pole.

To further enhance an important preferred feature of the invention, and now referring to Figure 11, the rectangular sectioned tubular secondary pole 18 is preferably connected at its lower end concentrically to a molded plastic bearing or guide 100 which is preferably molded of nylon or other low surface friction material suitable for this application. The bearing 100 includes a cylindrical inner surface 102 which slidably engages over the main support pole 20 in closely aligned fashion. Upwardly extending corner bosses 104 securely and tightly engage within the corners of the secondary support pole 18 and are self-retaining and self-aligning in this manner.

A support collar 10, also sized to snuggly fit over the outer surface of the main support pole 20 shown in phantom, is positioned therealong and secured permanently to the main support pole 20 as by blind rivets 112 through apertures 114 or by other suitable means such as by peening or denting the mating surfaces or by threaded mechanical fasteners. A separate friction ring 108, also formed of molded low-friction plastic, serves as a bearing between the lower ring-shaped surface 106 of bearing 100 and the upper surface of collar 110. By this arrangement, all of the weight of the umbrella top 12 is placed against collar 110 and, thusly, upon the upright main support pole 20.

The important preferred feature which the arrangement in FIG. 11 facilitates is the free rotation of the umbrella top 12 when in wind. As seen in FIG. 1A, when the wind is in the direction of arrow B, the leading edges of the respective vanes 16 lift into approximately the position there shown in phantom, which also induces a rotational force into the umbrella top 12. Rotation of the entire umbrella top 12 in the appropriate direction of arrow A then occurs, the main support pole 20 remaining stationary. By allowing this free rotation of the umbrella top 12 in response to wind, in addition to the lifting motion of each of the vanes 16, the likelihood of damage or upset of the umbrella top 12 is greatly reduced.

Lastly, the umbrella 10 may be provided with a decorative cap 28 which frictionally engages over the upper end of the main support pole 20. Upon removal of this cap 28, the umbrella top 12 may be lifted from the main support pole 20 for storage or cleaning.

While the instant invention has been shown and described herein in what are conceived to be the most practical and preferred embodiments, it is recognized that departures may be made therefrom within the scope of the invention, which is therefore not to be limited to the details disclosed herein, but is to be afforded the full scope of the claims so as to embrace any and all equivalent apparatus and articles.

What is claimed is:

1. A wind-resistant umbrella comprising:

an elongated main support pole;

a tubular secondary pole slidably translatable over said main support pole;

a hub having a periphery and connected at one end thereof to said secondary pole and supportively engaged against a support member on said main support pole whereby, when said main support pole is upright, said secondary pole and said hub are supported on said main support pole by said support member;

a plurality of vanes each having a central end, an outer end and trailing and leading longitudinal edges, said outer end being wider than said central end;

each said central end pivotally connected in evenly spaced relation to and around substantially the entire said hub periphery;

a vane carrier having a periphery and mounted for sliding translation over said secondary pole;

a plurality of rigid or semi-rigid vane support rods each having a central end thereof pivotally connected in evenly spaced relation to and around substantially the entire said vane carrier periphery;

an outer end of each said vane support rod pivotally connected along a mid point of said trailing longitudinal edge of each corresponding said vane;

a clip attached adjacent each said vane outer end;

an elongated substantially non-elastic cord extending circumferentially around and connected to each said clip;

said leading longitudinal edge of each said vane remaining free and overlapping said trailing longitudinal edge of the next adjacent said vane, whereby a portion of each said vane may lift free of the next adjacent said vane in a wind to permit venting of said umbrella.

2. A wind-resistant umbrella as set forth in claim 1, wherein:

each said vane includes a stiffening bead formed along the length of said leading longitudinal edge.

3. A wind-resistant umbrella as set forth in claim 2, wherein:

each said vane includes a downturned stiffening flange formed along the length of said trailing longitudinal edge.

4. A wind-resistant umbrella as set forth in claim 3, wherein:

each said outer end is downturned to produce an overhanging outer periphery on said umbrella.

5. A wind-resistant umbrella as set forth in claim 4, wherein:

each said central end is also universally connected to said hub periphery to facilitate vane axial rotation in wind.

6. A wind-resistant umbrella comprising:

an elongated main support pole;

an umbrella top including:

a tubular secondary pole slidably translatable and freely rotatable over said main support pole;

a hub having a periphery and connected at one end thereof to said secondary pole;

a support member on said main support pole supporting said hub and said secondary pole whereby, when said main support pole is upright, said secondary pole and said hub are supported at an upper end portion of said main support pole by said support member;

a plurality of vanes each having a central end, an outer end and trailing and leading longitudinal edges, said outer end being wider than said central end;

each said central end pivotally connected in evenly spaced relation to and around substantially the entire said hub periphery;

a vane carrier having a periphery and mounted for sliding translation only over said secondary pole;

a plurality of rigid or semi-rigid vane support rods each having a central end thereof pivotally connected in evenly spaced relation to and around substantially the entire said vane carrier periphery;

an outer end of each said vane support rod pivotally connected along a mid point of said trailing longitudinal edge of each corresponding said vane;

a clip attached adjacent each said vane outer end;

an elongated substantially non-elastic cord extending circumferentially around and connected to each said clip;

said leading longitudinal edge of each said vane remaining free and overlapping said trailing longitudinal edge of the next adjacent said vane, whereby a portion of each said vane may lift free of the next adjacent said vane and said umbrella top in a wind to permit venting of, and to prevent damage to, said umbrella.

7. A wind-resistant umbrella as set forth in claim 6, wherein:

each said vane includes a stiffening bead formed along the length of said leading longitudinal edge.

8. A wind-resistant umbrella as set forth in claim 7, wherein:

each said vane includes a downturned stiffening flange formed along the length of said trailing longitudinal edge.

9. A wind-resistant umbrella as set forth in claim 8, wherein:

each said outer end is downturned to produce an overhanging outer periphery on said umbrella top.

10. A wind-resistant umbrella as set forth in claim 9, wherein:

each said central end is also universally connected to said hub periphery to facilitate vane axial rotation in wind.

11. A collapsible wind-resistant umbrella comprising:

an elongated main support pole;

a tubular secondary pole slidably translatable over said main support pole;

a hub having a periphery and connected at one end thereof to said secondary pole;

a support member connected to said main support pole supporting said hub and said secondary pole from downward movement whereby, when said main support pole is upright, said secondary pole and said hub are supported on said main support pole by said support member;

a plurality of vanes each having a central end, an outer end and trailing and leading longitudinal edges, said outer end being wider than said central end;

each said central end pivotally connected in evenly spaced relation to and around substantially the entire said hub periphery;

a vane carrier having a periphery and mounted for sliding translation over said secondary pole between a closed and an open position;

a plurality of rigid or semi-rigid vane support rods each having a central end thereof pivotally connected in evenly spaced relation to and around substantially the entire said vane carrier periphery;

an outer end of each said vane support rod pivotally connected along a mid point of said trailing longitudinal edge of each corresponding said vane, a clip attached adjacent each said vane outer end;

an elongated substantially non-elastic cord extending circumferentially around and connected to each said clip;

said leading longitudinal edge of each said vane remaining free and overlapping said trailing longitudinal edge of the next adjacent said vane when said vane carrier is in said open position and said umbrella is also open, whereby a portion of each said vane may lift free of the next adjacent said vane in a wind to permit venting of said umbrella.

12. A wind-resistant umbrella as set forth in claim 11, wherein:

each said vane includes a stiffening bead formed along the length of said leading longitudinal edge.

13. A wind-resistant umbrella as set forth in claim 12, wherein:

each said vane includes a downturned stiffening flange formed along the length of said trailing longitudinal edge.

14. A wind-resistant umbrella as set forth in claim 13, wherein:

each said outer end is downturned to produce an overhanging outer periphery on said umbrella.

15. A wind-resistant umbrella as set forth in claim 14, wherein:

each said central end is also universally connected to said hub periphery to facilitate vane axial rotation in wind.

* * * * *